US012036635B2

(12) United States Patent
Oh et al.

(10) Patent No.: US 12,036,635 B2
(45) Date of Patent: Jul. 16, 2024

(54) METHODS OF DETECTING NON-CONFORMING SUBSTRATE PROCESSING EVENTS DURING CHEMICAL MECHANICAL POLISHING

(71) Applicant: Applied Materials, Inc., Santa Clara, CA (US)

(72) Inventors: Jeonghoon Oh, Saratoga, CA (US); Ashish Bhushan, Bangalore (IN); Jamie Stuart Leighton, Palo Alto, CA (US); John Anthony Garcia, San Jose, CA (US); Stephen Thomas Cormier, Leominster, MA (US); Nick Joseph Jackson, Broadway, NC (US); Manoj Balakumar, Bangalore (IN); Nandkishore Patidar, Barwaha (IN)

(73) Assignee: Applied Materials, Inc., Santa Clara, CA (US)

( * ) Notice: Subject to any disclaimer, the term of this patent is extended or adjusted under 35 U.S.C. 154(b) by 102 days.

(21) Appl. No.: 17/365,848

(22) Filed: Jul. 1, 2021

(65) Prior Publication Data

US 2022/0016739 A1 Jan. 20, 2022

(30) Foreign Application Priority Data

Jul. 14, 2020 (IN) ..... 202041029928

(51) Int. Cl.
*B24B 37/015* (2012.01)
*B24B 37/005* (2012.01)
(Continued)

(52) U.S. Cl.
CPC ..... *B24B 37/015* (2013.01); *B24B 37/005* (2013.01); *B24B 37/013* (2013.01);
(Continued)

(58) Field of Classification Search
CPC ... B24B 37/0053; B24B 37/013; B24B 37/10; B24B 49/14; B24B 49/16; B24B 7/228;
(Continued)

(56) References Cited

U.S. PATENT DOCUMENTS 5,812,403 A * 9/1998 Fong ..... C23C 16/4405 700/121
5,851,846 A * 12/1998 Matsui ..... H01L 21/31053 438/692
(Continued)

FOREIGN PATENT DOCUMENTS

CN 107877356 A 4/2018
CN 111316403 A 6/2020
(Continued)

OTHER PUBLICATIONS

International Search Report and Written Opinion of the International Searching Authority for PCT/US2021/037094 mailed Oct. 1, 2021, 12 pages.
(Continued)

*Primary Examiner* — Eileen P Morgan
(74) *Attorney, Agent, or Firm* — Patterson + Sheridan, LLP

(57) ABSTRACT

Embodiments of the present disclosure generally relate to chemical mechanical polishing systems (CMP) systems and processes used in the manufacturing of electronic devices. In particular, embodiments herein relate to methods of detecting non-conforming substrate processing events during a polishing process. In one embodiment, a method of processing a substrate on a polishing system includes urging a surface of a silicon carbide substrate against a polishing pad in the presence of a polishing fluid, determining a temperature of the polishing pad using a temperature sensor that is positioned above the platen, monitoring the temperature of the polishing pad, and, if the change in polishing pad
(Continued)

temperature reaches a threshold value, initiating a response using a controller of the polishing system.

15 Claims, 4 Drawing Sheets

(51) Int. Cl.
*B24B 37/013* (2012.01)
*B24B 37/04* (2012.01)
*B24B 49/14* (2006.01)
*B24B 49/16* (2006.01)

(52) U.S. Cl.
CPC ..... *B24B 37/042* (2013.01); *B24B 49/14* (2013.01); *B24B 49/16* (2013.01)

(58) Field of Classification Search
CPC ... B24B 37/005; B24B 37/015; B24B 37/042; B24B 49/02; B24B 49/04
USPC ..... 451/5, 7, 9, 10, 11, 41, 285, 287
See application file for complete search history.

(56) References Cited

U.S. PATENT DOCUMENTS 6,046,111 A * 4/2000 Robinson ..... B24B 37/013 438/693
6,241,847 B1 * 6/2001 Allman ..... B24B 37/013 438/692
6,464,824 B1 10/2002 Hofmann et al.
7,246,424 B2 * 7/2007 Huang ..... G11C 11/16 427/127
9,061,394 B2 6/2015 Chang et al.
9,862,070 B2 * 1/2018 Chang ..... B24B 37/013
2001/0009811 A1 * 7/2001 Robinson ..... H01L 21/2007 257/E21.546
2002/0037681 A1 * 3/2002 Gitis ..... G01B 17/08 451/287
2004/0005845 A1 * 1/2004 Kitajima ..... B24B 49/16 257/E21.244
2006/0063472 A1 * 3/2006 Matsumoto ..... B24B 37/015 451/7
2007/0287364 A1 * 12/2007 Shigeta ..... B24B 37/013 451/28
2010/0029177 A1 * 2/2010 Kobayashi ..... B24B 37/04 451/8
2013/0344773 A1 * 12/2013 Hiroo ..... B24B 49/12 451/41
2018/0229344 A1 * 8/2018 Ueno ..... B24B 7/228
2019/0039206 A1 * 2/2019 Watanabe ..... B24B 37/20
2019/0275633 A1 * 9/2019 Dhandapani ..... B24B 49/10
2020/0001427 A1 * 1/2020 Soundararajan ..... B24B 37/27
2021/0170541 A1 * 6/2021 Ishii ..... B24B 37/10
2023/0139947 A1 * 5/2023 Ito ..... B24B 37/105 451/41

FOREIGN PATENT DOCUMENTS

DE 102017130885 B4 1/2020
EP 739687 A3 8/1997
JP 2000117620 A * 4/2000 ..... B24B 37/11
JP 2005317621 A 11/2005
JP 2006093180 A 4/2006
JP 2008068338 A * 3/2008
JP 2008068338 A 3/2008
KR 20190092180 A 8/2019
TW 402551 B 8/2000
TW 200423201 A * 11/2004 ..... C25D 17/001
TW 201946135 A 12/2019
TW 202000368 A 1/2020
WO 2014158410 A1 10/2014

OTHER PUBLICATIONS

Taiwan Office Action issued to Patent Application No. 110124930 on Aug. 22, 2023.
Japanese Office Action issued to Patent Application No. 2023-502796 on Jan. 9, 2024.
Korean Office Action issued to patent application No. 10-2023-7004767 on May 17, 2024.

* cited by examiner

METHODS OF DETECTING NON-CONFORMING SUBSTRATE PROCESSING EVENTS DURING CHEMICAL MECHANICAL POLISHING

BACKGROUND

Field

Embodiments described herein generally relate to chemical mechanical polishing (CMP) systems and processes used in the manufacturing of electronic devices. In particular, embodiments herein relate to methods of detecting non-conforming substrate processing events during a polishing process.

Description of the Related Art

Chemical mechanical polishing (CMP) is commonly used in the manufacturing of semiconductor devices to planarize or polish a layer of material deposited on a crystalline silicon (Si) substrate surface. In a typical CMP process, the substrate is retained in a substrate carrier which presses the backside of the substrate towards a rotating polishing pad in the presence of a polishing fluid. Generally, the polishing fluid comprises an aqueous solution of one or more chemical constituents and nanoscale abrasive particles suspended in the aqueous solution. Material is removed across the material layer surface of the substrate in contact with the polishing pad through a combination of chemical and mechanical activity which is provided by the polishing fluid and the relative motion of the substrate and the polishing pad.

CMP may also be used in the preparation of silicon carbide (SiC) substrates which, due to the unique electrical and thermal properties thereof, provide superior performance to Si substrates in advanced high power and high frequency semiconductor device applications. For example, CMP may be used to planarize and to remove sub-surface damage caused by previous grinding and/or lapping operations used in the production of the SiC substrates and to prepare the SiC substrate for subsequent epitaxial SiC growth thereon. Typical grinding and/or lapping operations use abrasive particles, such as diamond, boron nitride, or boron carbide, which are harder than the SiC surface in order to achieve reasonable SiC material removal rates therefrom. CMP of SiC, however, typically employs abrasive particles having a hardness which is about the same or less than that of SiC so as to not cause further damage to the SiC substrate surface. One result of the relatively low hardness of abrasive particles used in a typical SiC CMP process, along with the generally chemically inert nature of SiC materials, is that CMP of SiC substrates is a very slow process that requires a very long cycle time when compared to CMP of a material layer, e.g, a dielectric or metal layer, in a typical semiconductor device manufacturing process.

Once polishing is complete, the SiC substrate may be removed from the polishing system for post-CMP cleaning and then for post-CMP measurement operations, e.g., by use of a stand-alone non-contact interferometry system, which may be used to monitor the performance of the CMP process. Unfortunately, the relatively long cycle time associated with SiC substrate CMP processing, combined with the lack of real-time monitoring of CMP system performance, often results in a delay in detecting a non-conforming process event using post-CMP measurements. The long delay in detecting a non-conforming process event may result in undesirable rework or loss of subsequently processed substrates and a corresponding increase in substrate processing costs associated therewith.

Accordingly, what is needed in the art are methods of detecting and contemporaneously responding to non-conforming substrate processing events in a CMP process.

SUMMARY

Embodiments of the present disclosure generally relate to chemical mechanical polishing systems (CMP) systems and processes used in the manufacturing of electronic devices. In particular, embodiments herein relate to methods of detecting non-conforming substrate processing events during a polishing process.

In one embodiment, a method of processing a substrate is provided. The method includes urging a surface of a substrate against a polishing pad. Here, the polishing pad is disposed on a rotating platen and the substrate is disposed in a substrate carrier. Urging the surface of the substrate against the polishing pad includes rotating the substrate carrier while exerting a downward force on the substrate. The method further includes receiving polishing pad temperature information from a temperature sensor. The temperature sensor is positioned to measure a polishing pad temperature at a location proximate to a trailing edge of the substrate carrier. The method further includes determining, using the polishing pad temperature information, a rate of change in the polishing pad temperature over time, comparing the rate of change of the polishing pad temperature to a predetermined control limit, and communicating an out-of-control event to a user. Here, the out-of-control event comprises a rate of change of the polishing pad temperature that is equal to or outside of the predetermined control limit.

In another embodiment, a method of polishing a substrate is provided. The method includes urging a surface of a substrate disposed in a substrate carrier against a polishing pad disposed on a rotating platen. Urging the surface of the substrate against the polishing pad includes rotating the substrate carrier while exerting a downward force on the substrate. The method further includes receiving motor torque information from one or more motor torque sensors. The one or more motor torque sensors are positioned to measure platen motor and/or substrate carrier motor torque. The method further includes determining a rate of change in the motor torque information over time using the motor torque information from the one or more motor torque sensors, comparing the rate of change of the motor torque information to predetermined control limit, and communicating an out-of-control event to a user. Here, the out-of-control event comprises a rate of change of the motor torque information that is equal to or outside of the predetermined control limit.

In another embodiment, a polishing system is provided. The polishing system includes a rotatable platen, a substrate carrier disposed over the rotatable platen and facing there towards, and a temperature sensor disposed over the rotatable platen. Here, the temperature sensor is positioned to measure a polishing pad temperature at a location proximate to a trailing edge of the substrate carrier. The polishing system further includes a computer readable medium having instructions stored thereon for a substrate processing method. The method includes urging a surface of a substrate against a polishing pad, receiving polishing pad temperature information from the temperature sensor, determining, using the polishing pad temperature information, a rate of change in the polishing pad temperature over time, comparing the rate of change of the polishing pad temperature to a predetermined control limit, and communicating an out-of-control event to a user. Here, the out-of-control event comprises a rate of change of the polishing pad temperature that is equal to or outside of the predetermined control limit. Typically, the polishing pad is disposed on the rotatable platen, the substrate is disposed in the substrate carrier, and urging the surface of the substrate against the polishing pad includes rotating the platen and the substrate carrier while exerting a downward force on the substrate.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to chemical mechanical polishing systems (CMP) systems and processes used in the manufacturing of electronic devices. In particular, embodiments herein relate to methods of detecting non-conforming substrate processing events during CMP processing of crystalline silicon carbide (SiC) substrates.

Figure 1A:
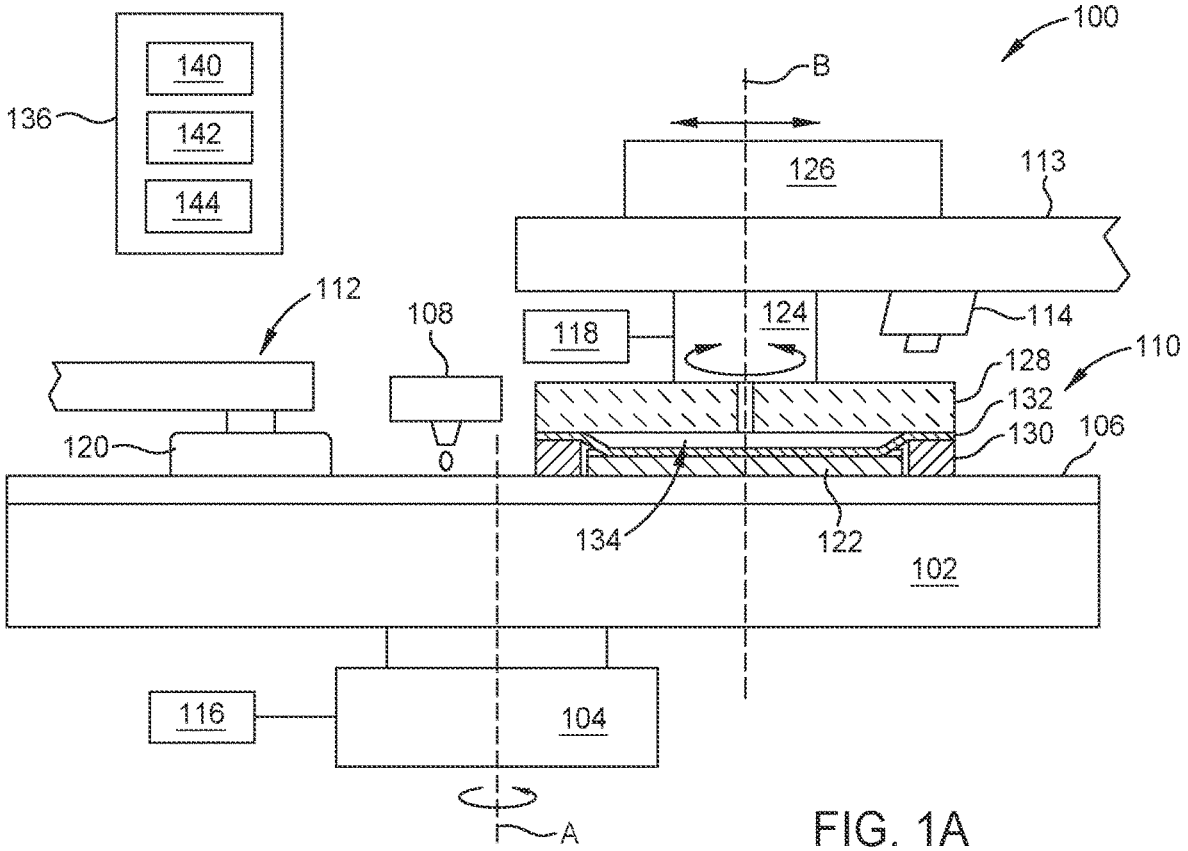
FIG. 1A is a schematic side view of an exemplary polishing station which may be used to practice the methods set forth herein, according to one embodiment.
Figure 1B:
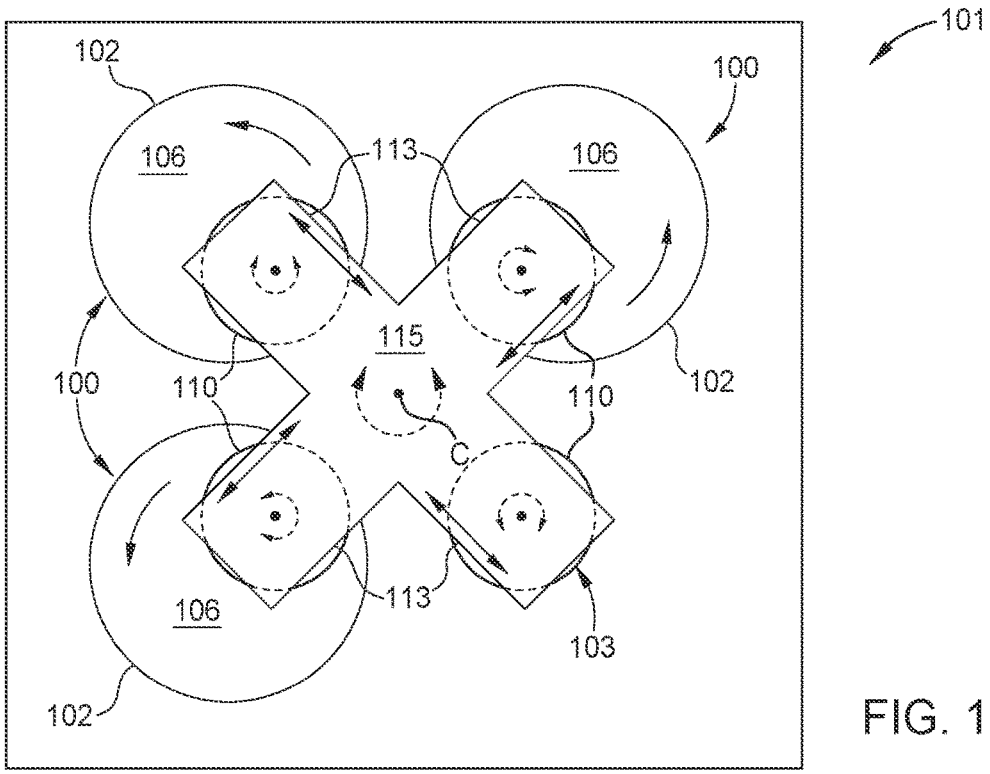
FIG. 1B is a schematic plan view of a multi-station polishing system which may be used to practice the methods set forth herein, according to one embodiment.

FIG. 1A is a schematic side view of a polishing station 100, according to one embodiment, which may be used to practice the methods set forth herein. FIG. 1B is a schematic plan view of a multi-station polishing system 101 comprising a plurality of polishing stations 100, where each of the polishing stations 100*a-c* are substantially similar to the polishing station 100 described in FIG. 1A. In FIG. 1B at least some of the components with respect to the polishing station 100 described in FIG. 1A are not shown on the plurality of polishing stations 100 in order to reduce visual clutter.

As shown in FIG. 1A, the polishing station 100 includes a platen 102, a first actuator 104 coupled to the platen 102, a polishing pad 106 disposed on the platen 102 and secured thereto, a fluid delivery arm 108 disposed over the polishing pad 106, a substrate carrier 110 (shown in cross-section), and a pad conditioner assembly 112. Here, the substrate carrier 110 is suspended from a carriage arm 113 of a substrate handling carriage 115 (FIG. 1B) so that the substrate carrier 110 is disposed over the polishing pad 106 and faces there towards. The substrate handling carriage 115 is used to move the substrate carrier 110, and thus a substrate 122 chucked therein, between a substrate loading station 103 and/or between polishing stations 100 of the multi-station polishing system 101. In embodiments herein, individual ones of the polishing stations 100 further include one or more sensors (e.g., 114, 116, and 118) which may be used to monitor various corresponding processing parameters and to facilitate the methods set forth herein.

During substrate polishing, the first actuator 104 is used to rotate the platen 102 about a platen axis A and the substrate carrier 110 is disposed above the platen 102 and faces there towards. The substrate carrier 110 is used to urge a to-be-polished surface of a substrate 122, disposed therein, against the polishing surface of the polishing pad 106 while simultaneously rotating about a carrier axis B. The substrate 122 is urged against the polishing pad 106 in the presence of a polishing fluid provided by the fluid delivery arm 108. Typically, the rotating substrate carrier 110 oscillates between an inner radius and an outer radius of the platen 102 to, in part, reduce uneven wear of the surface of the polishing pad 106. Here, the substrate carrier 110 is rotated using a second actuator 124 and is oscillated using a third actuator 126.

Here, the substrate carrier 110 features a carrier head 128, a carrier ring 130 coupled to the carrier head 128, and a flexible membrane 132 disposed radially inward of the carrier ring 130 to provide a mounting surface for the substrate 122. The flexible membrane 132 is coupled to the carrier head 128 to collectively define a volume 134 therewith. During substrate polishing, the carrier ring 130 circumscribes the substrate 122 to prevent the substrate 122 from slipping from the substrate carrier 110. The volume 134 is pressurized to cause the flexible membrane 132 to exert a downward force on the substrate 122 while the substrate carrier 110 rotates thus urging the substrate 122 against the polishing pad 106. Before and after polishing, a vacuum is applied to the volume 134 so that the flexible membrane 132 is deflected upwards to create a low pressure pocket between the flexible membrane 132 and the substrate 122, thus vacuum-chucking the substrate 122 to the substrate carrier 110.

Here, the pad conditioner assembly 112 comprises a fixed abrasive conditioning disk 120, e.g., a diamond impregnated disk, which may be urged against the polishing pad 106 to rejuvenate the surface thereof and/or to remove polishing byproducts or other debris therefrom. In other embodiments, the pad conditioner assembly 112 may comprise a brush (not shown).

In embodiments herein, the one or more sensors include one or a combination of a polishing pad temperature sensor 114, such as an infrared (IR) temperature sensor, a platen torque sensor 116, and a carrier torque sensor 118. Typically, the pad temperature sensor 114 is disposed above the platen 102 and faces there towards. The pad temperature sensor 114 is positioned to measure the polishing pad temperature directly behind the substrate carrier 110 in the direction of the platen 102 rotation, i.e., proximate to the trailing edge of the substrate carrier 110. In some embodiments, the pad temperature sensor 114 is coupled to the carriage arm 113.

Here, the platen torque sensor 116 is coupled to the first actuator 104 and the carrier torque sensor 118 is coupled to second actuator 124. In some embodiments, the platen torque sensor 116 and the carrier torque sensor 118 are used to monitor motor currents used to rotate the platen 102 and the substrate carrier 110 about their respective axis A, B.

Here, operation of the multi-station polishing system 101 and/or the individual polishing stations 100 thereof is facilitated by a system controller 136 (FIG. 1A). The system controller 136 includes a programmable central processing unit (CPU 140) which is operable with a memory 142 (e.g., non-volatile memory) and support circuits 144. The support circuits 144 are conventionally coupled to the CPU 140 and comprise cache, clock circuits, input/output subsystems, power supplies, and the like, and combinations thereof coupled to the various components of the multi-station polishing system 101, to facilitate control of a substrate polishing process. For example, in some embodiments the CPU 140 is one of any form of general purpose computer processor used in an industrial setting, such as a programmable logic controller (PLC), for controlling various polishing system components and sub-processors. The memory 142, coupled to the CPU 140, is non-transitory and is typically one or more of readily available memory such as random access memory (RAM), read only memory (ROM), floppy disk drive, hard disk, or any other form of digital storage, local or remote.

Herein, the memory 142 is in the form of a computer-readable storage media containing instructions (e.g., non-volatile memory), that when executed by the CPU 140, facilitates the operation of the multi-station polishing system 101. The instructions in the memory 142 are in the form of a program product such as a program that implements the methods of the present disclosure (e.g., middleware application, equipment software application, etc.). The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

Figure 1C:
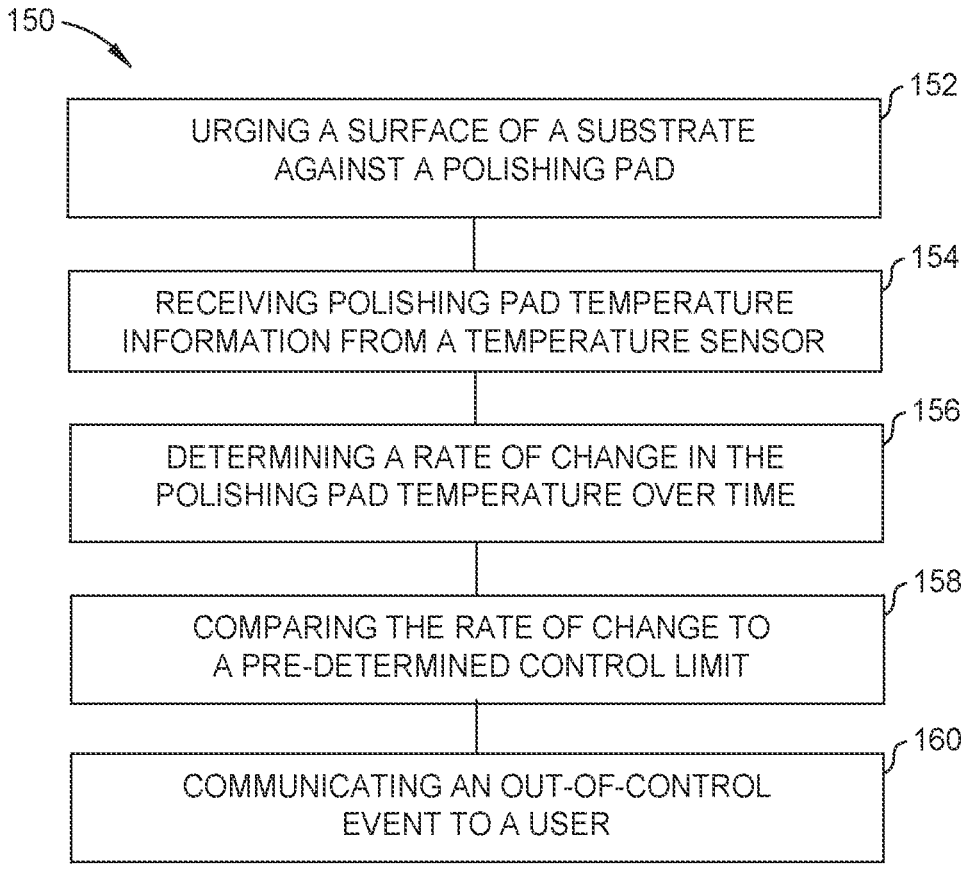
FIG. 1C is a diagram describing a method of monitoring a polishing process for non-conforming substrate processing events and responding thereto, according to one embodiment.
Figure 2A:
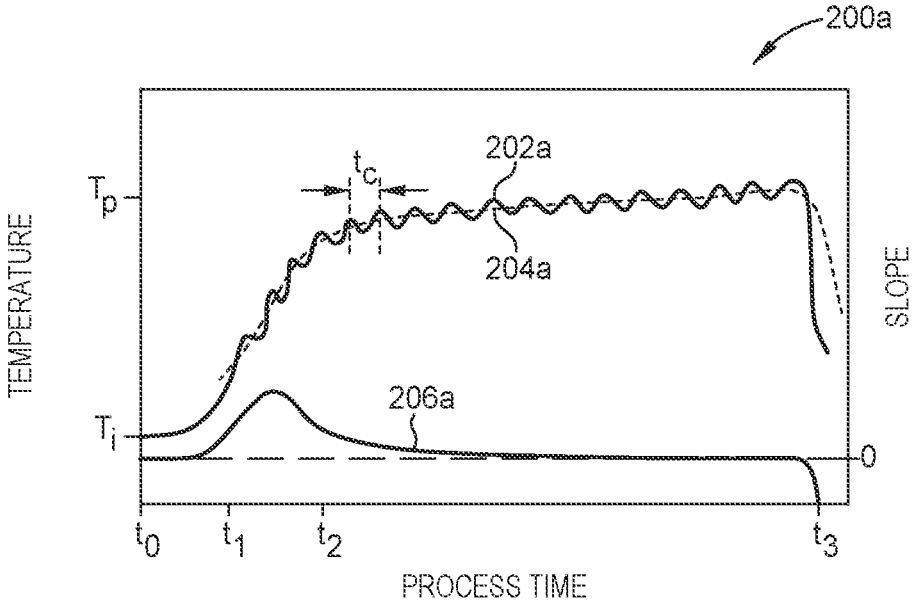
FIGS. 2A-2B are schematic representations of changes in polishing pad temperature over time which may be used to illustrate aspects of the method described in FIG. 1C.
Figure 2B:
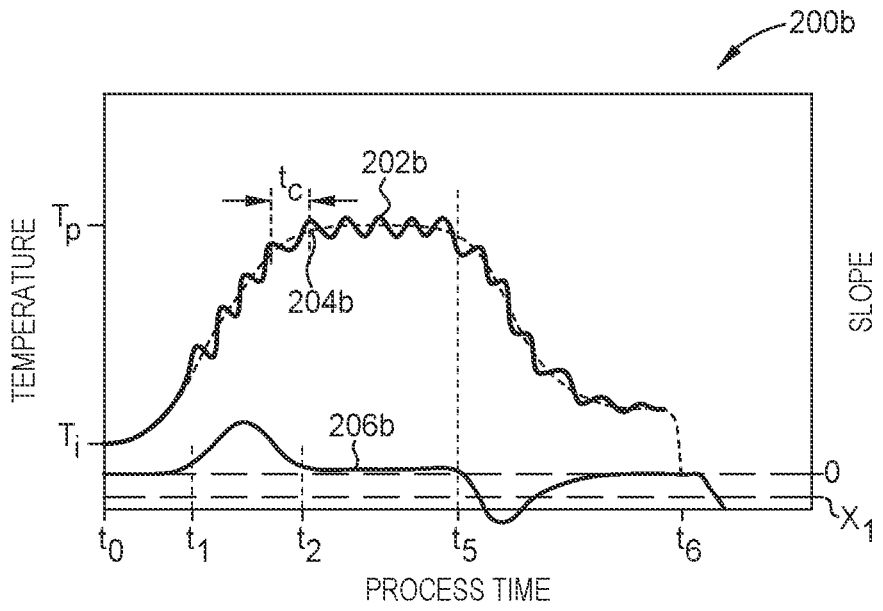

FIG. 1C is a diagram illustrating a method 150 of detecting a non-conforming processing event using polishing pad temperature information received from the pad temperature sensor 114. FIGS. 2A-2B are used herein to illustrate various aspects of the method 150.

FIG. 2A schematically illustrates a temperature profile from a polishing process 200*a* for a silicon carbide substrate where the polishing process begins at time to and ends at time $t_3$. Typically from time $t_0$ to time $t_1$ the polishing process is ramping up by increasing the rotational velocities of the platen 102 and the substrate carrier 110 and the downforce used to urge the substrate 122 against the polishing pad 106. At time $t_1$ the substrate carrier 110 oscillation begins causing the corresponding oscillation in the polishing pad temperature information 202*a*. From time $t_1$ to time $t_2$ the polishing pad temperature information 202*a* increases fairly rapidly from an initial temperature $T_i$ to a processing temperature $T_p$ where the temperature may stabilize or gradually increase therefrom during the remainder of the polishing process. The increase in temperature from $T_i$ to $T_p$ is typically caused by a combination of an exothermic reaction of the SiC surface with the chemically active constituents of the polishing fluid and by the heat produced by the friction between the polishing pad 106 and the substrate 122.

Generally, for a given set of polishing parameters, the processing temperature $T_p$ will vary depending on any number of factors such as the age of polishing consumables, e.g., the polishing pad 106 and/or the abrasive conditioning disk 120, the surface roughness of the incoming silicon carbide substrate, the stage in a multi-platen polishing process, and/or variations in polishing fluid flowrates between platens or between substrates polished on an individual platen. Variation in processing temperatures $T_p$, which occur between platens 102 in the multi-station polishing system 101 and/or from substrate to substrate polished on an individual platen 102, may render the processing temperature $T_p$ an unreliable indicator for determining whether the polishing process is operating normally. Thus, in embodiments herein, the method 150 typically monitors a rate of change 206*a* of the polishing pad temperature information 202*a* during the polishing process for indications that the polishing process is not behaving normally, e.g., for non-conforming polishing events, such as substrate breakage.

At activity 152 the method 150 includes urging a surface of a substrate 122 against a polishing pad 106. Here, the polishing pad 106 is disposed on a rotating platen 102 and the substrate 122 is disposed in a substrate carrier 110. Typically, urging the surface of the substrate 122 against the polishing pad 106 includes rotating the substrate carrier 110 while exerting a downward force on the substrate 122. In some embodiments, urging the substrate 122 against the polishing pad 106 includes oscillating the substrate carrier 110 between an inner radius and an outer radius of the polishing pad 106. Typically, the SiC substrates polished using the method 150 feature a first surface having a Si-face (0001) and second surface, opposite the first surface, the second surface having a C-face (0001). The method 150 may be used for the polishing process of one or both of the first surface and the second surface and/or may be used for each polishing stage of a multi-stage polishing process. For example, in some embodiments polishing a surface of a SiC substrate includes a plurality of polishing stages each of which takes place using a corresponding individual one of the plurality of polishing stations 100. In some embodiments, the polishing process is substantially similar at each of the polishing stations 100, e.g., having the same type of polishing pads 106, using the same type of polishing fluid, and/or using substantially similar polishing parameters, such as polishing downforce and platen and carrier rotational velocities. In other embodiments, one or more of the polishing stations, e.g., the third polishing station may be configured differently, e.g., having a different type of polishing pad 106 from the other polishing stations 100 and/or using a different type of polishing fluid. Typically, when the third polishing station is differently configured from the other polishing stations 100, it will provide a finer, or less aggressive, polishing process to reduce sub-surface damage in the finished SiC substrate. In other embodiments, the first surface may comprise an a-face (1120) and the second surface will thus comprise a m-face (1100).

At activity 154, the method 150 includes receiving polishing pad temperature information 202*a-b* from a pad temperature sensor 114. Here, the pad temperature sensor 114 is positioned to measure the polishing pad temperature at a location proximate to a trailing edge of the substrate carrier 110, i.e., behind the substrate carrier 110 in the direction of the platen 102 rotation. The pad temperature is communicated from the pad temperature sensor 114 to the system controller 136 as the polishing pad temperature information 202*a-b*.

In FIGS. 2A-2B the polishing pad temperature information 202*a-b* each has a generally sinusoidal pattern where an oscillation in the polishing pad temperature at the measurement location corresponds to the oscillation of the substrate carrier 110 between the inner radius and the outer radius of the polishing pad 106. In some embodiments, an oscillation period $t_c$ of the substrate carrier 110, e.g., from the inner radius to the outer radius and back to the inner radius, is in a range from about 3 seconds to about 20 seconds, such as in a range from about 3 seconds to about 15 seconds, such as from about 3 seconds to about 10 seconds.

In some embodiments, the method 150 further includes processing the polishing pad temperature information 202*a-b* to smooth the local oscillations therefrom which might otherwise obscure the rate of change 206*a-b* in the polishing pad temperature over time. For example, in some embodiments, the method 150 includes using a software implemented algorithm to approximate the polishing pad temperature over time with substantially reduced amplitude of the individual oscillations (having the period $t_c$) included therein, i.e., to provide smoothed temperature data 204*a-b* shown in FIGS. 2A-2B respectively.

In some embodiments, the algorithm used to generate the smoothed temperature data 204*a-b* uses a moving average to process the polishing pad temperature information 202*a-b*. A moving average is a process to average time-series data, e.g., the polishing pad temperature information 202*a-b* from a predetermined time window (moving average time window) while moving the time window. Typically, the moving average time window is about 20 seconds or less, such as about 15 seconds or less, about 10 seconds or less, or about 5 seconds or less. In other embodiments, the smoothed temperature data 204*a-b* may be generated using any suitable signal method for reducing the apparent oscillation, or amplitude thereof, of the polishing pad temperature information 202*a-b*.

At activity 156 the method 150 includes determining, using the polishing pad temperature information 202*a-b*, a corresponding rate of change 206*a-b* in the polishing pad temperature over time. Here, the rate of change 206*a-b* in the polishing pad temperature is determined using a derivative of the smoothed temperature data 204*a-b* at a given time where the derivative corresponds to a tangent line to the smoothed temperature data 204*a-b* at that time. In other embodiments, the rate of change 206*a-b* may be determined graphically, e.g., by determining the slope of a secant line disposed through a first point on the curve formed by the smoothed temperature data 204*a-b* at a first time and a second point proximate to the first point, e.g., within 0.5 seconds of the first point.

At activity 158 the method 150 includes comparing the rate of change 206*a-b* of the polishing pad temperature information 202*a-b* to a predetermined control limit. The predetermined control limit may be a lower limit, e.g., the lower limit X1 shown in FIG. 2B, or an upper limit (not shown). In some embodiments, the rate of change 206*a-b* may be compared to both a lower and an upper control limit. Herein, a rate of change 206*a-b* that is less than a lower limit is "outside of the lower limit" and a rate of change 206*a-b* that is more than an upper limit is "outside of the upper limit."

At activity 160 the method 150 includes communicating an out-of-control event to a user, where the out-of-control event comprises a rate of change 206*a-b* of the polishing pad temperature information 202*a-b* that is equal to or outside of the predetermined control limit. Typically, communicating the out-of-control event to the user includes using any form of an alert designed to indicate to a desired user that an out-of-control event has occurred. For example, communicating the out-of-control event to the user may include using visual and audio alarms and/or, electronic messaging, e.g., automatically generated email or automatically generated text messages. In some embodiments, the system controller 136 is configured to end and/or suspend substrate processing operations based on the out-of-control event. In some embodiments, the system controller 136 is configured to initiate a change in the polishing process based on the out-of-control event, e.g., by changing one or more polishing parameters thereof. In some embodiments, the system controller 136 is configured to communicate the out-of-control event to a fab-level control system (not shown) communicatively coupled thereto. An example of an out-of-control event is illustrated in FIG. 2B.

FIG. 2B schematically illustrates a temperature profile for a polishing process 200*b* having an out-of-control event at about time $t_5$. Here, the beginning of the temperature profile is similar to that shown for the polishing process 200*a* in FIG. 2A. For example, from time $t_1$ to time $t_2$ the polishing pad temperature information 202*b* increases fairly rapidly from the initial temperature $T_i$ to a processing temperature $T_p$ where the temperature may stabilize or gradually increase therefrom during the remainder of the polishing process. At about time $t_5$, the substrate fractures (breaks) causing a relatively rapid decrease in the heat produced by the friction between the substrate surface and the polishing pad 106 and a corresponding drop in the polishing pad temperature information 202*b*. The relatively rapid drop in the polishing pad temperature information 202*b* is reflected in the rate of change 206*b* which falls below the predetermined control limit $X_1$.

In FIG. 2B, the method 150 is used to communicate the out-of-control event to a user and to end the polishing process at time $t_6$ which is before the expected substrate processing end time $t_3$ shown in FIG. 2A. By communicating the out-of-control event to a user and/or ending the polishing process, the method 150 beneficially reduces the amount of damage that may be caused to the multi-station polishing system 101 by a non-conforming substrate processing event and/or undesirable rework or loss of subsequently processed substrates. Thus, the method 150 advantageously avoids the corresponding increase in substrate processing costs associated with a non-conforming substrate processing event. Examples of non-conforming substrate processing events, which may be detected using the method 150, include substrate breakage, interruptions or undesired changes in polishing fluid flowrates, e.g., a clogged polishing fluid delivery nozzle, processing component failure, e.g., breach or rupture of the flexible membrane 132 of the substrate carrier 110, and/or human error, e.g., polishing of an already polished SiC substrate surface and/or polishing of a Si-face or C-face surface of the substrate when polishing of the opposite surface is desired.

Figure 3A:
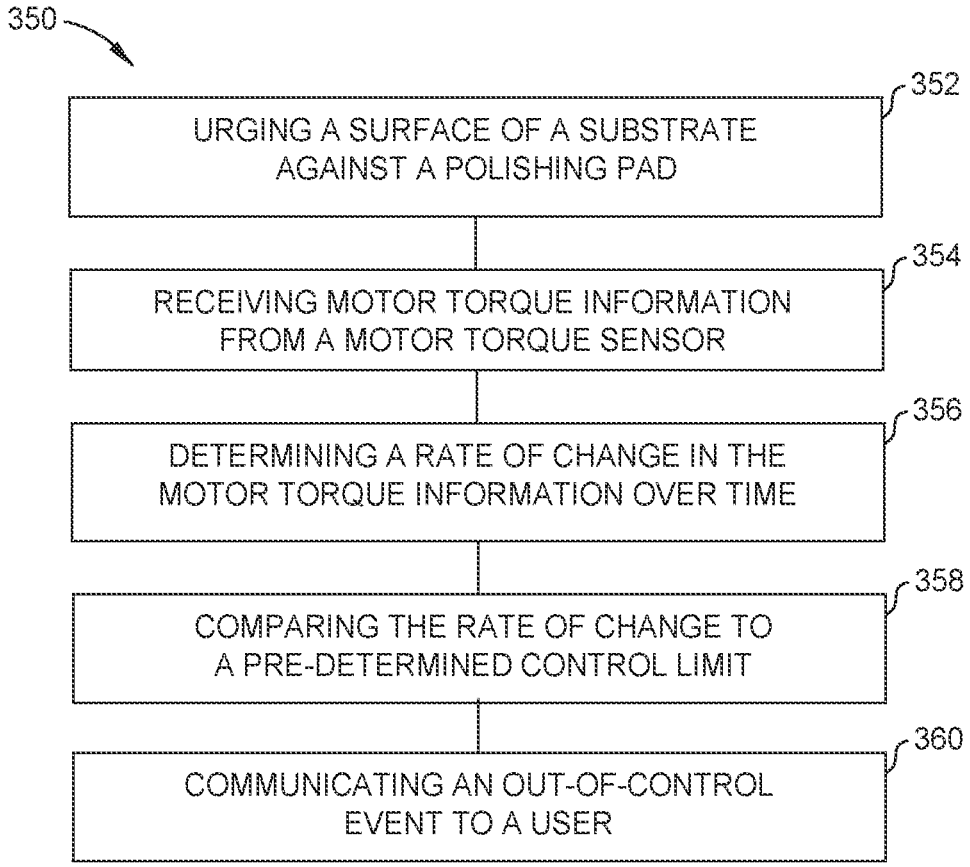
FIG. 3A is a diagram describing a method of monitoring a polishing process for non-conforming substrate processing events and responding thereto, according to another embodiment.
Figure 3B:
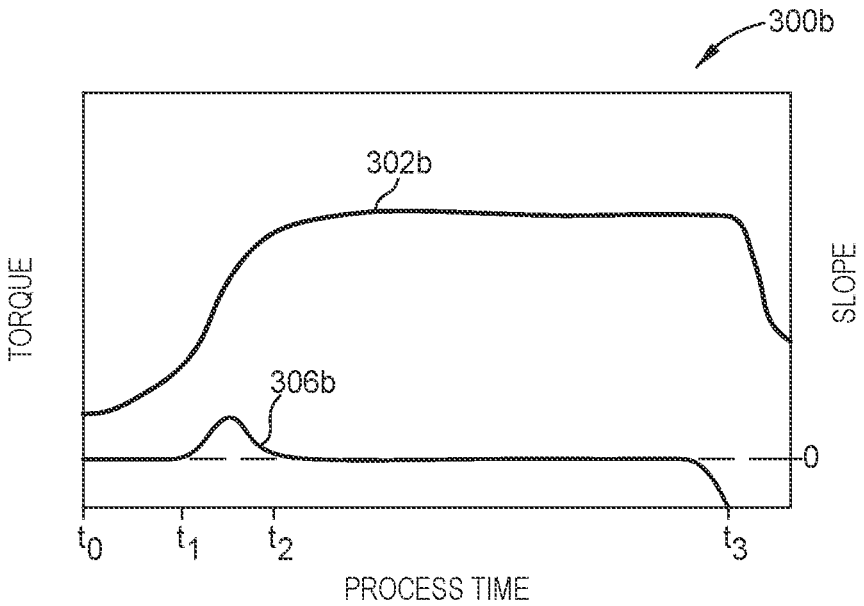
FIGS. 3B-3C are schematic representations of changes in platen motor torque information over time which may be used to illustrate aspects of the method described in FIG. 3A.
Figure 3C:
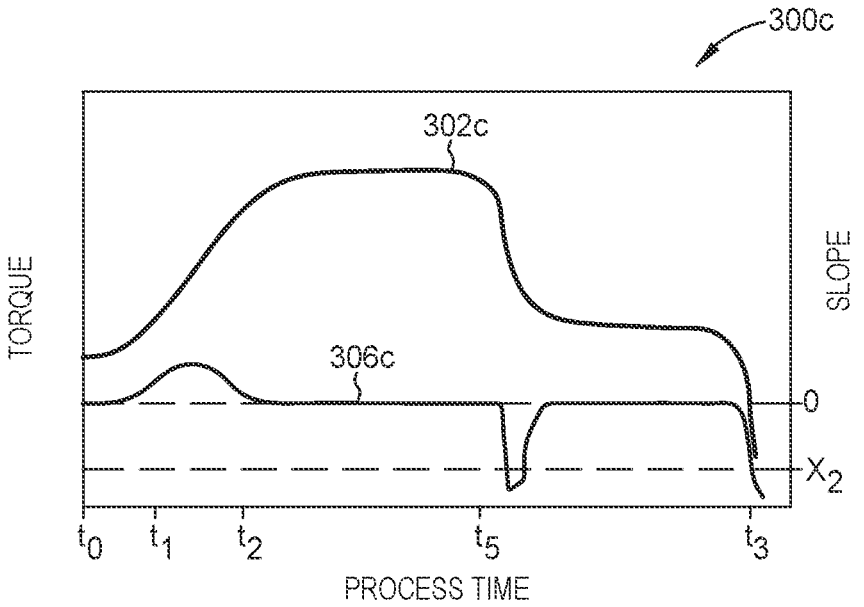

FIG. 3A is a diagram illustrating a method 350 of detecting a non-conforming processing event using motor torque information received from one or both of the platen torque sensor 116 and the carrier torque sensor 118. FIGS. 3B-3C are used herein to illustrate various aspects of the method 350.

FIGS. 3B-3C respectively schematically illustrate a platen torque profile from a typical polishing process (300*b*) for a silicon carbide substrate where the polishing process begins at time to and ends at time $t_3$ and for an atypical polishing process (300*c*) having a non-conforming substrate processing event. Here, the platen torque profiles include platen motor torque information 302*b-c* received from the platen torque sensor 116 and a rate of change 306*b-c* in the respective platen motor torque information 302*b-c*.

At activity 352 the method 350 includes urging a surface of a substrate 122 against a polishing pad 106. Activity 352 of the method 350 may be the same or substantially similar to activity 152 of the method 150 described in FIG. 1C.

At activity 354 the method 350 includes receiving motor torque information 302*b-c* from one or both of the platen torque sensor 116 or the carrier torque sensor 118.

At activity 356 the method 350 includes determining, using the motor torque information 302*b-c*, a corresponding rate of change 306*b-c* in the motor torque information 302*b-c* over time. The rate of change 306*b-c* in the motor torque information 302*b-c* may be determined using any suitable method, such as one or a combination of the methods used to determine the rate of change 206*a-b* in the polishing pad temperature information 202*a-b* described in activity 156 of the method 150.

At activity 358 the method 350 includes comparing the rate of change 306*b-c* of the motor torque information 302*b-c* to a predetermined control limit. The predetermined control limit may be a lower limit, e.g., the lower limit $X_2$ shown in FIG. 3C, or an upper limit (not shown). In some embodiments, the rate of change 306*b-c* may be compared to both a lower and an upper control limit. Herein, a rate of change 306*b-c* that is less than a lower limit is "outside of the lower limit" and a rate of change 306*b-c* that is more than an upper limit is "outside of the upper limit."

At activity 360 the method 350 includes communicating an out-of-control event to a user, where the out-of-control event comprises a rate of change 306*b-c* of the motor torque information 302*b-c* that is equal to or outside of the predetermined control limit. The method of communication may be the same as one or combination of the communication methods described in activity 160 of the method 150. In some embodiments, the method 350 includes ending, suspending, or initiating a change in substrate processing operations based on the out-of-control event.

FIG. 3C schematically illustrates a platen motor torque for an atypical polishing process 300*c* having an out-of-control event at about time $t_5$. Here, the beginning of the motor torque profile is similar to that shown for the polishing process 300*b* in FIG. 3B. For example, from time $t_1$ to time $t_2$ the motor torque information 302*c* increases fairly rapidly as the substrate processing parameters, e.g., rotation of the platen 102 and the downforce exerted against the substrate 122 ramp up. Once the desired rotational velocity of the platen 102 is reached, the motor torque required to maintain the desired rotational velocity generally stabilizes, gradually increases, or gradually decreases during the remainder of a typical polishing process (e.g., to time $t_3$ shown in FIG. 3B). In the atypical polishing process 300*c* shown in FIG. 3*c*, the substrate fractures (breaks) at about time $t_5$ causing a relatively rapid decrease in the friction between the surface of the substrate 122 and the polishing the polishing pad 106 and thus resulting in a corresponding drop in the motor torque required to maintain the set rotational velocity of the platen 102. The relatively rapid drop in the motor torque information 302*c* is reflected in the rate of change 306*c* which, here, falls below the predetermined control limit $X_2$.

In some embodiments, the method 350 is used in combination with the method 150 described in FIG. 1C. For example, in such an embodiment, both the rate of change of the motor torque information over time and the rate of change in the polishing pad temperature over time are determined and compared to corresponding predetermined control limits. If either is determined to exceed the corresponding control limit, an out-of-control event is communicated to a user.

While the foregoing is directed to embodiments of the present disclosure, other and further embodiments of the disclosure may be devised without departing from the basic scope thereof, and the scope thereof is determined by the claims that follow.

The invention claimed is:

1. A method of processing a substrate on a polishing system, comprising:

(a) urging a surface of a substrate against a polishing pad, wherein the substrate is disposed in a substrate carrier, and wherein urging the surface of the substrate against the polishing pad comprises translating the substrate carrier relative to the polishing pad while exerting a downward force on the substrate;

(b) receiving polishing pad temperature information from a pad temperature sensor, wherein the pad temperature sensor is positioned to measure a polishing pad temperature at a location proximate to a trailing edge of the substrate carrier;

(c) determining a rate of change in the polishing pad temperature over time, using the polishing pad temperature information;

(d) comparing the rate of change of the polishing pad temperature to a predetermined control limit;

(e) communicating an out-of-control event to a user, wherein the out-of-control event comprises a determination that the rate of change of the polishing pad temperature is equal to or outside of the predetermined control limit; and (f) at least one of suspending substrate processing operations or changing a substrate processing operation during substrate processing based on the out-of-control event.

2. The method of claim 1, wherein urging the surface of the substrate against the polishing pad further comprises oscillating the substrate carrier between an inner diameter and an outer diameter of the polishing pad coupled to a rotating platen.

3. The method of claim 2, wherein an oscillation of the substrate carrier is associated with corresponding oscillations in the polishing pad temperature information, wherein the method further comprises generating, from the polishing pad temperature information, smoothed temperature data, and wherein an amplitude of an oscillation in the smoothed temperature data is reduced from a corresponding amplitude of the oscillation in the polishing pad temperature information.

4. The method of claim 1, wherein the out-of-control event is caused by a fracture in the substrate.

5. The method of claim 1, wherein the rate of change in the polishing pad temperature information is determined using smoothed temperature data.

6. The method of claim 5, wherein the rate of change is further determined by using a slope of a secant line disposed through a first point at a first time and second point proximate to the first point at a second time on a curve formed by smoothed temperature data.

7. The method of claim 1, wherein the pad temperature sensor is positioned to measure the polishing pad temperature at a location proximate to a trailing edge of the substrate carrier in a direction of rotation of the polishing pad coupled to a rotating platen.

8. A polishing system, comprising:

a rotatable platen;

a substrate carrier disposed over the rotatable platen and facing there towards;

a temperature sensor disposed over the rotatable platen, wherein the temperature sensor is positioned to measure a polishing pad temperature at a location proximate to a trailing edge of the substrate carrier; and a computer readable medium having instructions stored thereon for a substrate processing method, the method comprising:

(a) urging a surface of a substrate against a polishing pad, wherein the polishing pad is disposed on the rotatable platen, wherein the substrate is disposed in a substrate carrier, and wherein urging the surface of the substrate against the polishing pad comprises rotating the rotatable platen and the substrate carrier while exerting a downward force on the substrate;

(b) receiving polishing pad temperature information from the temperature sensor;

(c) determining, using the polishing pad temperature information, a rate of change in the polishing pad temperature over time;

(d) comparing the rate of change of the polishing pad temperature to a predetermined control limit;

(e) communicating an out-of-control event to a user, wherein the out-of-control event comprises a determination that the rate of change of the polishing pad temperature is equal to or outside of the predetermined control limit; and (f) at least one of suspending substrate processing operations or changing a substrate processing operation during substrate processing based on the out-of-control event.

9. The polishing system of claim 8, further comprising a system controller configured to suspend or change substrate processing operations based on the out-of-control event.

10. The polishing system of claim 8, further comprising oscillating the substrate carrier between an inner diameter and an outer diameter of the rotatable platen.

11. The polishing system of claim 10, wherein the oscillation of the substrate carrier is associated with corresponding oscillations in the polishing pad temperature information, wherein the method further comprises generating, from the polishing pad temperature information, smoothed temperature data, and wherein an amplitude of an oscillation in the smoothed temperature data is reduced from a corresponding amplitude of the oscillation in the polishing pad temperature information.

12. The polishing system of claim 8, wherein the rate of change in the polishing pad temperature information is determined by using a slope of a secant line disposed through a first point a first time and second point proximate to the first point at a second time on a curved formed by smoothed temperature data.

13. A method of polishing a substrate comprising:

(a) urging a surface of a substrate against a polishing pad, wherein the substrate is disposed in a substrate carrier, and wherein urging the surface of the substrate against the polishing pad comprises translating the substrate carrier relative to the polishing pad while exerting a downward force on the substrate;

(b) receiving motor torque information from one or more motor torque sensors;

(c) determining a rate of change in the motor torque information over time using the motor torque information from the one or more motor torque sensors, wherein the rate of change in motor torque is determined using smoothed motor torque data;

(d) comparing the rate of change of the motor torque information to a predetermined control limit;

(e) communicating to a desired user a first out-of-control event, wherein the first out-of-control event comprises a determination that the rate of change of the motor torque information is equal to or outside of the predetermined control limit;

(f) at least one of suspending substrate processing operations or changing a substrate processing operation during substrate processing based on the first out-of-control event (g) receiving polishing pad temperature information from a pad temperature sensor, wherein the pad temperature sensor is positioned to measure a polishing pad temperature at a location proximate to a trailing edge of the substrate carrier;

(h) determining a rate of change in the polishing pad temperature over time, using the polishing pad temperature information;

(i) comparing the rate of change of the polishing pad temperature to a predetermined control limit; and (j) communicating a second out-of-control event to a user, wherein the second out-of-control event comprises a determination that the rate of change of the polishing pad temperature is equal to or outside of the predetermined control limit; and (k) at least one of suspending substrate processing operations or changing a substrate processing operation during substrate processing based on the second out-of-control event.

14. The method of claim 13, wherein the polishing pad is coupled to a platen driven by a platen motor, and wherein the one or more motor torque sensors comprise a platen motor torque sensor configured to measure platen motor torque.

15. The method of claim 13, wherein the one or more motor torque sensors comprises a substrate carrier motor torque sensor configured to measure substrate carrier motor torque.

* * * * *